United States Patent [19]

Grosch

[11] 4,136,850

[45] Jan. 30, 1979

[54] FORM FOR POOL DECKS

[76] Inventor: Gregory E. Grosch, 1153 Del Sol La., Diamond Bar, Calif. 91766

[21] Appl. No.: 797,991

[22] Filed: May 18, 1977

[51] Int. Cl.[2] ..... E04G 11/04

[52] U.S. Cl. ..... 249/19; 249/DIG. 3

[58] Field of Search ..... 52/169.6, 169.7; 249/19, DIG. 3

[56] References Cited

U.S. PATENT DOCUMENTS

| | | | |
|---|---|---|---|
| 3,348,801 | 10/1967 | Deason | 249/DIG. 3 |
| 3,831,897 | 8/1974 | Stegmeier | 249/DIG. 3 |
| 3,850,403 | 11/1974 | Stegmeier | 249/19 |
| 3,904,717 | 9/1975 | Stegmeier | 249/DIG. 3 |
| 3,967,422 | 7/1976 | Stegmeier | 249/DIG. 3 |

*Primary Examiner*—Richard B. Lazarus
*Assistant Examiner*—John McQuade
*Attorney, Agent, or Firm*—Lyon & Lyon

[57] ABSTRACT

A structure formed of semi-rigid material including a set of first form units, of rectangular cross-section, adapted to be secured in end-to-end relation about the margin of a pool with their upper edges being flush with the upper edge of the pool wall, each first form unit having at least two transversely extending plugs capable of receiving nails which are driven therethrough and into the rim of the pool wall; and further including a second set of form units, of rectangular cross-section and of greater width than the first form units so as to project thereabove to provide an edge form for a deck slab poured on the upper edge of the pool wall, the confronting surfaces of the form units being attached by pressure sensitive adhesive strips, whereby the second form units are strippable from the first form units to expose the edge of the deck slab for finishing with an appropriate hand tool.

10 Claims, 5 Drawing Figures

FORM FOR POOL DECKS

BACKGROUND

It is customary in the construction of swimming pools or the like to provide a concrete deck. Initially the edge forms have been supported and held in place by framework extending across the pool area. Such forms are expensive, and troublesome to install and remove. Several attempts have been made utilizing a single piece of light weight foamed plastic removably attached to tile previously secured to the pool wall as direct adhesive contact between the concrete surface and the foamed plastic has proven impractical. One such type of form is disclosed in U.S. Pat. Nos. 3,526,070 and 3,967,422.

SUMMARY

The present invention is directed to an expendable form for pool decks which is summarized in the following objects:

First, to provide a form for pool decks, wherein the form includes a set of first form units cast of foamed plastic material provided with nail receiving plugs so that the first form units may be secured directly to the concrete wall margin of the pool to provide initial support for a cantilevered marginal portion of the pool deck.

Second, to provide a form for pool decks, as indicated in the preceding object, wherein the form includes a set of second form units also case of foamed plastic material, which are mounted over and project above the first foam units to form the edge surface of the pool deck.

Third, to provide a form for pool decks, as indicated in the preceding objects, wherein the second form units are removable after initial set of the concrete, while the cantilevered margin of the deck remains supported by the first form units, whereby the edge surface of the deck thus exposed may be troweled to improve the finish.

Fourth, to provide a form for pool decks, corners of the first and second form units confronting corners of the cantilevered deck portion which may be reinforced to provide a guide for an edging or shaping tool.

Fifth, to provide a form for pool decks, wherein severable tie wires may be disposed contiguous to the upper surface of the deck and extend through the second form units to aid in retaining the second form units in place.

DETAILED DESCRIPTION

Figure 1:
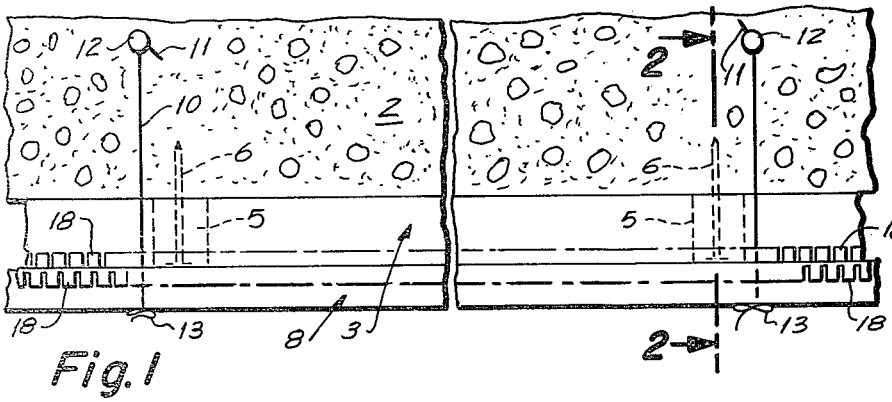
FIG. 1 is a fragmentary top view of the form for pool decks showing an adjacent portion of the pool deck.
Figure 5:
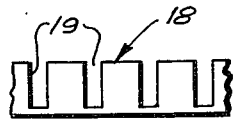
FIG. 5 is a fragmentary top view of a reinforcing element used in conjunction with the form.
Figure 2:
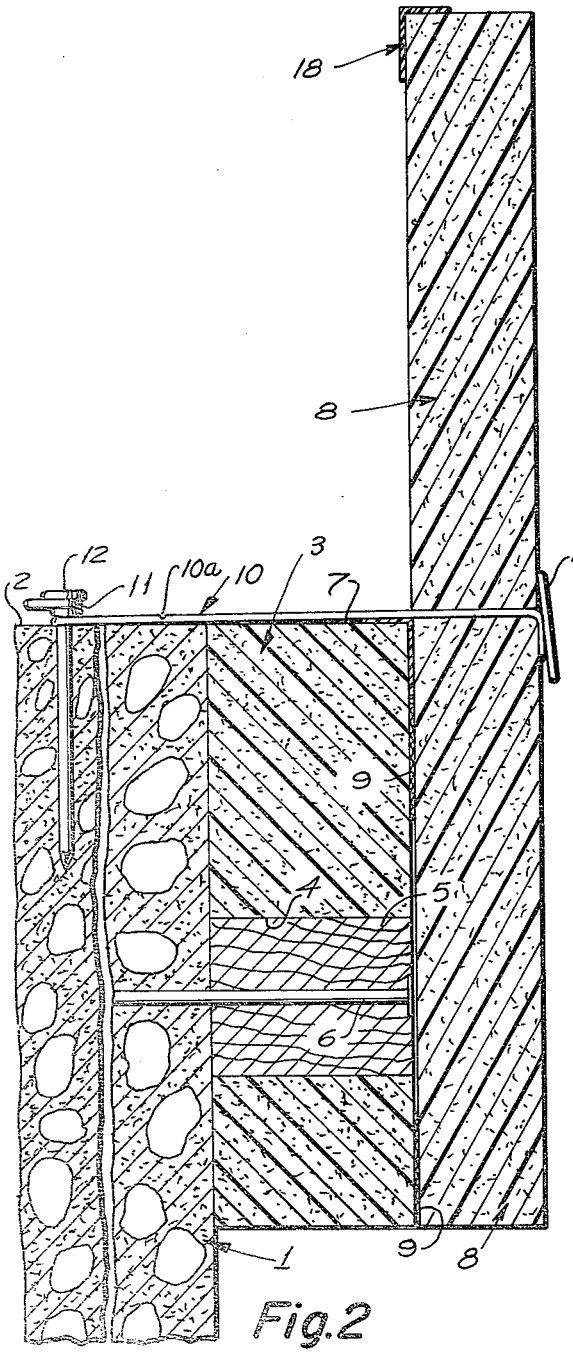
FIG. 2 is an enlarged fragmentary sectional view thereof taken through 2—2 of FIG. 1 before pouring the deck concrete.

The present invention is directed to a form for use about the periphery of a concrete shell intended for use as a swimming pool. The upper portion of the shell is defined by an essentially vertically extending periphery wall 1 terminating in an upper face 2 over which it is intended to apply a concrete pool deck. The present invention includes a set of first form units 3 formed of foamed plastic material such as, but not limited to, an expanded, unicellular foam type material having a polystyrene base such as known under the trademark "Styrafoam". Such material is capable of being deformed so as to conform to the wall 1, which is usually curved. The members of a set of the form units are placed end-to-end about the periphery of the pool wall 1.

In order to secure the first form units 3 in place, each form unit is provided with a pair or more of perforations 4, each of which receives a plug 5 which may be formed of wood or appropriate plastic material. The plugs 5 are cemented in place. Whether the plug is formed of wood or plastic, it is capable of receiving a nail 6 or other concrete penetrating element. If desired, the plug may be predrilled to reduce the force required for the nail to penetrate the plug, or the perforation may be such as to freely receive the nail. The plugs serve to distribute the force exerted by the nails when a force lateral to the nails is applied to the first form units. The first form units 3 are installed by pressing the form unit into conformity with the pool wall 1 with the upper edge 7 thereof disposed approximately flush with the upper face 2.

After the set of first form units 3 have been secured in position, a set of second form units 8 is applied to the first formed units. The members of the second form units are, like the first form units, also cast of foamed plastic material and are rectangular in cross-section. The thickness of the second form units may be less than the thickness of the first form units and the vertical dimension is equal to the vertical dimension of the first form units 3 plus the intended thickness of the pool deck slab.

The two sets of form units are joined together by pressure sensitive adhesive strips 9 which are double coated. That is, both sides of the adhesive strip 9 is provided with a pressure sensitive adhesive coating. The strips 9 may be initially applied to either set of form units and are initially provided with appropriate cover strips, not shown, so as to protect the adhesive prior to use. In the construction shown, one cover strip is removed and the adhesive strip 9 is applied to the lower portions of a second form unit 8, then after removal of the second protective strips, the second form units 8 are pressed against the first form units 3 with their lower edges flush with the lower edges of the first form units in order to effect uniform extension of the second form units above the first form units.

To increase resistance to forces exerted during pouring of the pool deck, tie wires 10 are wrapped as indicated by 11 about nails 12 which are driven into the upper face 2 of the wall 1. The wires are disposed adjacent the face 2 and upper edge of the first form units 3 and penetrate the second form units 8. Their outer ends are folded against the outer surface of the form units 8, as indicated by 13. The wires may be nicked, as indicated by **10*a***, so that the outer portions may be broken free by twisting.

Figure 3:
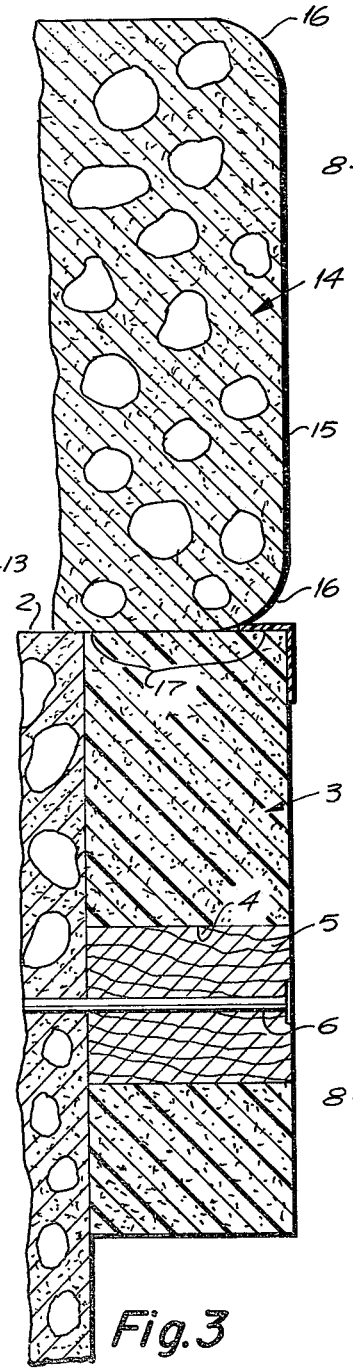
FIG. 3 is a fragmentary sectional view, similar to FIG. 2, showing the form and the pool deck after being poured.
Figure 4:
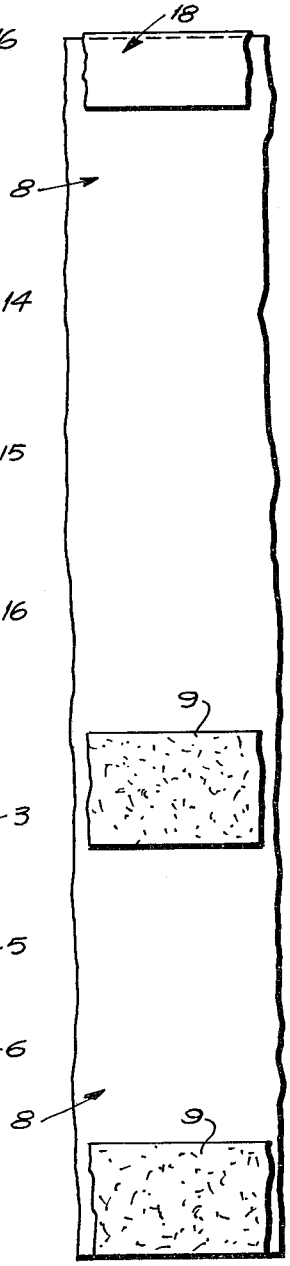
FIG. 4 is an enlarged fragmentary side view of one of the form units.

The concrete pool deck slab 14 is then poured until flush with the upper edges of the second form units 8. While the concrete slab is still in for shaping with appropriate hand tools, tie wires 10 are broken and the second form units 8 are stripped from the first form units 3 exposing the edge surface 15 of the slab 14 so that the surface may be finished and the corners of the slab rounded as indicated by 16 in FIG. 3. During this operation, the first form units provide support for the cantilevered margin 17 of the pool deck slab. The thickness of the first set of form units determines the width of the cantilevered margin of the slab.

It has been found desirable to reinforce the upper outer corner of each first form unit 3 and to similarly reinforce the upper inner corner of each second form unit 8 so as to provide a guide to aid in edging or shaping the concrete without cutting into the form material comprising the form units. This is accomplished in each case by a reinforcing angle strip 18 formed of plastic material, one side of which is provided with a series of slots 19 so that the angle strips 18 may bend into conformity with the curvature of the pool wall 1. The reinforcing strips 18 are cemented in place by appropriate adhesive, not shown.

After the deck slab 14 has set, the first form units 3 are removed. The nails 6 are also removed or driven against the pool wall. It will be observed that the pool deck slab 14 is poured before tile or other decorative coating is applied to the pool wall 1.

Having fully described my invention, it is to be understood that I am not to be limited to the details herein set forth, but that my invention is of the full scope of the appended claims.

I claim:

1. A form attachable to the upper periphery of a pool wall, for casting a cantilevered margin of a concrete slab pool deck, said form comprising:

a. a set of first form units being molded of deformable foamed plastic material having a surface adapted to conform to the upper periphery of the pool wall and having an upper surface adapted to be positioned essentially flush with the upper terminum of the pool wall;

b. sets of concrete penetrating elements adapted to extend through the form units and into the concrete forming the upper periphery of the pool wall to secure the first form units in conformity therewith;

c. means distributing the force of the penetrating elements with respect to the first form units;

d. a set of second form units, molded of deformable foamed plastic material to present a surface conformable to the outer extended surface of the first form units, and projecting above the first form units a distance approximating the intended thickness of the cantilevered margin of the deck slab to be formed above the first form units;

e. and adhesive means removably joining the outer extended surface of the set of first form units and confronting surface of the set of second form units.

2. A form, as defined in claim 1, wherein:

a. said set of second form units are removable from the set of first form units during setting of the deck slab while the cantilevered margin thereof remains supported by the first form units whereupon the exposed edge of the deck slab is available for finishing.

3. A form, as defined in claim 1, wherein:

a. the force distributing means are members of substantially larger diameter than the concrete penetrating elements extending transversely through the set of first form units and bonded thereto.

4. A form, as defined in claim 1, wherein:

a. a form reinforcing element extends along the upper, outer margins of the first form units to aid in shaping the concrete.

5. A form, as defined in claim 3, wherein:

a. a form reinforcing element extends along the upper, inner margins of the second form units to aid in shaping the concrete.

6. A form attachable to the upper periphery of a pool wall, for casting a cantilevered margin of a concrete slab pool deck, said form comprising:

a. a set of first form units, each unit being essentially rectangular in cross-section and molded of deformable foamed plastic material, each form unit having at least a pair of nail receiving plugs secured transversely therein;

b. said first form units adapted to be pressed into conformity with the upper periphery of the pool wall with their upper edges disposed essentially flush with the upper terminus of the pool wall and nailed through said plugs to the wall;

c. a set of second form units, each second form unit also being essentially rectangular in cross-section and of greater width than the first form units and molded of deformable foamed plastic material;

d. adhesive means removably connecting the second form units in overlying relation to the extended surfaces of the first foam units with the second form units extending above the first form units a distance approximating the intended thickness of the cantilevered margin of the deck slab to be formed above the first form units, whereby after pouring the concrete deck slab, the second form units are removable to permit troweling the exposed edge of the deck slab while the cantilevered portion thereof remains supported by the first form units.

7. A form attachable to the upper periphery of a concrete pool wall for casting a cantilevered margin of a concrete pool deck slab, said form comprising:

a. a set of first form units, molded of foamed plastic material capable of being deformed into conformity with the upper periphery of a concrete pool wall;

b. said first form units having means for removably attaching the first form units directly to the upper periphery of the concrete pool wall with their upper sides essentially flush with the upper extremity of the pool wall to provide a supporting surface for a cantilevered margin of the concrete slab, said attaching means including a series of force distributing elements set in said first form units and a series of securing elements driven through said force distributing elements and adapted to penetrate into the concrete pool wall;

c. a set of second form units molded of foamed plastic material capable of being deformed into conformity with the extended surface of the first form units;

d. bonding means between the first and second form units having less strength than the attaching means for the first form units whereby the second form units may be removed without disturbing the first form units;

e. the second form units projecting above the first form units a height at least corresponding to the thickness of the concrete pool deck slab and serving to mold the extended surface of the pool deck slab; and f. said second form units adapted to be removed while the concrete is still workable to permit finishing of said extended surface of the pool deck slab while the first form units remain in place to afford support for the cantilevered portion thereof.

8. A pool deck slab form, as defined in claim 7, wherein:

a. the bonding means between the first and second form units is at least one strip having pressure sensitive adhesive on both sides of the strip.

9. A pool deck slab form, as defined in claim 7, wherein:

a. reinforcing strips carried by the form units confront the lower and upper corners of the extended pool deck slab for engagement by finishing tools.

10. A pool deck slab form, as defined in claim 7, wherein:

a. a series of tie wires which are adapted to be secured to the upper surface of the pool wall, overlie the upper ends of the first form units penetrate the second form units, and overlie the outer surface thereof to augment the bonding means, said tie wires being severable to permit removal of the second form units.

* * * * *